US011464094B2

(12) United States Patent
Tang

(10) Patent No.: US 11,464,094 B2
(45) Date of Patent: Oct. 4, 2022

(54) CONTROL CIRCUIT AND RELATED LIGHTING SYSTEM

(71) Applicant: XIAMEN ECO LIGHTING CO. LTD., Xiamen (CN)

(72) Inventor: Xiaojun Tang, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 59 days.

(21) Appl. No.: 16/822,494

(22) Filed: Mar. 18, 2020

(65) Prior Publication Data

US 2020/0337134 A1 Oct. 22, 2020

(30) Foreign Application Priority Data

Apr. 22, 2019 (CN) ..... 201910322973.X

(51) Int. Cl.
*H05B 45/382* (2020.01)
*H05B 45/325* (2020.01)

(52) U.S. Cl.
CPC ..... *H05B 45/382* (2020.01); *H05B 45/325* (2020.01)

(58) Field of Classification Search
None
See application file for complete search history.

(56) References Cited

U.S. PATENT DOCUMENTS 6,218,817 B1 * 4/2001 Chang ..... G11C 11/4074 323/283
6,469,917 B1 * 10/2002 Ben-Yaakov ..... H02M 1/4225 363/44
6,982,648 B2 * 1/2006 Cros ..... B60Q 11/00 340/642
9,035,575 B2 * 5/2015 Lee ..... H05B 45/44 315/315
9,723,663 B2 * 8/2017 Kaashoek ..... H05B 45/3725
9,871,366 B1 * 1/2018 Li ..... H02H 3/044
2011/0062888 A1 * 3/2011 Bondy ..... H05B 45/10 315/294
2012/0306272 A1 * 12/2012 Winger ..... H02J 7/0068 307/31
2013/0285614 A1 * 10/2013 Winger ..... H02J 7/0068 320/128
2014/0129061 A1 * 5/2014 Cooper ..... H04L 63/00 701/19
2015/0061611 A1 * 3/2015 Li ..... H02M 3/1588 323/235
2015/0200712 A1 * 7/2015 Cooper ..... H04W 28/08 375/257
2015/0217790 A1 * 8/2015 Golden ..... B60T 17/228 701/19
2016/0359741 A1 * 12/2016 Cooper ..... H04W 4/44
(Continued)

*Primary Examiner* — Srinivas Sathiraju
(74) *Attorney, Agent, or Firm* — Chun-Ming Shih; Lanway IPR Services

(57) ABSTRACT

A control circuit includes: a power supply module, arranged to generate an output power to control an operation mode of a lighting device according to a control signal and a supply power; a switching module, coupled to the supply power, for selectively generating a first voltage signal of the supply power; and a signal controlling module, coupled between the switching module and the power supply module, for generating the control signal according to the first voltage signal.

15 Claims, 3 Drawing Sheets

(56) References Cited

U.S. PATENT DOCUMENTS

| | | | | |
|---|---|---|---|---|
| 2017/0200414 | A1* | 7/2017 | Li | G09G 3/3233 |
| 2017/0299134 | A1* | 10/2017 | Lane | H05B 47/105 |
| 2019/0115748 | A1* | 4/2019 | Li | H02H 7/228 |
| 2020/0196415 | A1* | 6/2020 | Wen | H05B 45/382 |
| 2020/0196424 | A1* | 6/2020 | Lin | H05B 47/14 |
| 2020/0287537 | A1* | 9/2020 | Telefus | H03K 17/6874 |
| 2020/0304016 | A1* | 9/2020 | De Bondt | H02M 1/36 |
| 2020/0329542 | A1* | 10/2020 | Xing | H05B 47/195 |
| 2020/0337134 | A1* | 10/2020 | Tang | H05B 47/10 |
| 2020/0344854 | A1* | 10/2020 | Tang | H05B 47/10 |
| 2020/0389093 | A1* | 12/2020 | Tietema | H02M 1/08 |

* cited by examiner

CONTROL CIRCUIT AND RELATED LIGHTING SYSTEM

FIELD

The present invention relates to a power supply control circuit, and more particularly to a power supply control circuit for a lighting device.

BACKGROUND

In the field of lighting system, the Light Emitting Diode (LED) device has the advantages of high luminous efficiency, low heat generation, low power consumption, and long lifetime. Therefore, the use of LED devices are increasingly prevalent in the field of lighting system. However, the conventional power supply control circuits for the LED device have complicate structure and high cost. Therefore, providing a simple and low cost power supply control circuit for the LED device is an urgent need in this field.

SUMMARY

Embodiments of the present invention provide a control circuit. The control circuit comprises: a power supply module, arranged to generate an output power to control an operation mode of a lighting device according to a control signal and a supply power; a switching module, coupled to the supply power, for selectively generating a first voltage signal of the supply power; and a signal controlling module, coupled between the switching module and the power supply module, for generating the control signal according to the first voltage signal.

In one embodiment of the control circuit, the control circuit further comprises: a signal detecting module, coupled between the switching module and the signal controlling module, for detecting a voltage level of the first voltage signal received from the switching module.

In one embodiment of the control circuit, wherein the power supply module comprises a first connecting terminal and a second connecting terminal, the first connecting terminal is coupled to the first voltage signal of the supply power and the second connecting terminal is coupled to a reference voltage of the supply power, and the switching module is coupled to the first connecting terminal.

In one embodiment of the control circuit, wherein the switching module comprises a self-locking wall switch or a non-self-locking wall switch.

In one embodiment of the control circuit, the control circuit further comprises: a signal converting module, coupled between the switching module and the signal controlling module, for converting the first voltage signal into a first current signal; wherein the signal controlling module is arranged to generate the control signal according to the first current signal.

In one embodiment of the control circuit, wherein the first current signal is a PWM signal.

In one embodiment of the control circuit, the control circuit further comprises: a signal detecting module, coupled between the switching module and the signal converting module, for detecting a voltage level of the first voltage signal received from the switching module.

In one embodiment of the control circuit, the control circuit further comprises: a protection module, coupled between the switching module and the signal detecting module, for protecting the control circuit from a power spike occur in the supply power.

In one embodiment of the control circuit, wherein the protection module comprises: a fuse, having a first terminal coupled to the switching module; and a resistor, having a first terminal coupled to a second terminal of the fuse, and a second terminal coupled to the signal detecting module.

In one embodiment of the control circuit, wherein the signal converting module comprises: an optical coupler, having a light emitter and a light receiver; wherein the light emitter is coupled to the switching module for generating a light signal according to the first voltage signal, and the light receiver is arranged to generate the first current signal by sensing the light signal.

In one embodiment of the control circuit, wherein the signal converting module further comprises: a first resistor, having a first terminal coupled to an input terminal of the light receiver, and a second terminal for receiving an external voltage; and a second resistor, having a first terminal coupled to the input terminal of the light receiver, and a second terminal for outputting the first current signal; wherein an output terminal of the light receiver is coupled to a reference voltage.

In one embodiment of the control circuit, wherein the external voltage falls within a range of 3.0V-5.0V.

In one embodiment of the control circuit, the control circuit further comprises: a voltage regulating module, coupled between the switching module and the signal controlling module, for regulating the first voltage signal.

In one embodiment of the control circuit, wherein the voltage regulating module comprises: a Zener diode, having an anode coupled to the switching module and the signal controlling module, and a cathode coupled to a reference voltage.

Embodiments of the present invention provide a control circuit. The control circuit comprises: a power supply module, having a first connecting terminal coupled to a first voltage signal of a supply power, a second connecting terminal receiving a control signal, and an output terminal generating an output power to a lighting device according to the control signal and the supply power; and a switching module, having a first terminal coupled to the first connecting terminal, and a second terminal coupled to the second connecting terminal, for conducting the first voltage signal to the second terminal from the first terminal for a first time interval to generate the control signal for controlling a first operation mode of the lighting device, and for conducting the first voltage signal to the second terminal from the first terminal for a second time interval to generate the control signal for controlling a second operation mode of the lighting device; wherein the first time interval is different from the second time interval.

In one embodiment of the control circuit, wherein the second time interval is greater than the first time interval, the first operation mode is a switching mode of the lighting device, and the second operation mode is a luminance or color adjusting mode of the lighting device.

In one embodiment of the control circuit, wherein the switching module comprises a self-locking wall switch or a non-self-locking wall switch.

Embodiments of the present invention provide a lighting system. The lighting system comprises: a lighting device; and a control circuit, coupled to the lighting device, for controlling an operation mode of the lighting device. The control circuit comprises: a power supply module, arranged to generate an output power to control the operation mode of the lighting device according to a control signal and a supply power; a switching module, coupled to the supply power, for selectively generating a first voltage signal of the supply power; and a signal controlling module, coupled between the switching module and the power supply module, for generating the control signal according to the first voltage signal.

In one embodiment of the lighting system, wherein the control circuit further comprises: a signal detecting module, coupled between the switching module and the signal controlling module, for detecting a voltage level of the first voltage signal received from the switching module.

In one embodiment of the lighting system, wherein the control circuit further comprises: a signal converting module, coupled between the switching module and the signal controlling module, for converting the first voltage signal into a first current signal; wherein the signal controlling module is arranged to generate the control signal according to the first current signal.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DETAILED DESCRIPTION

Figure 1:
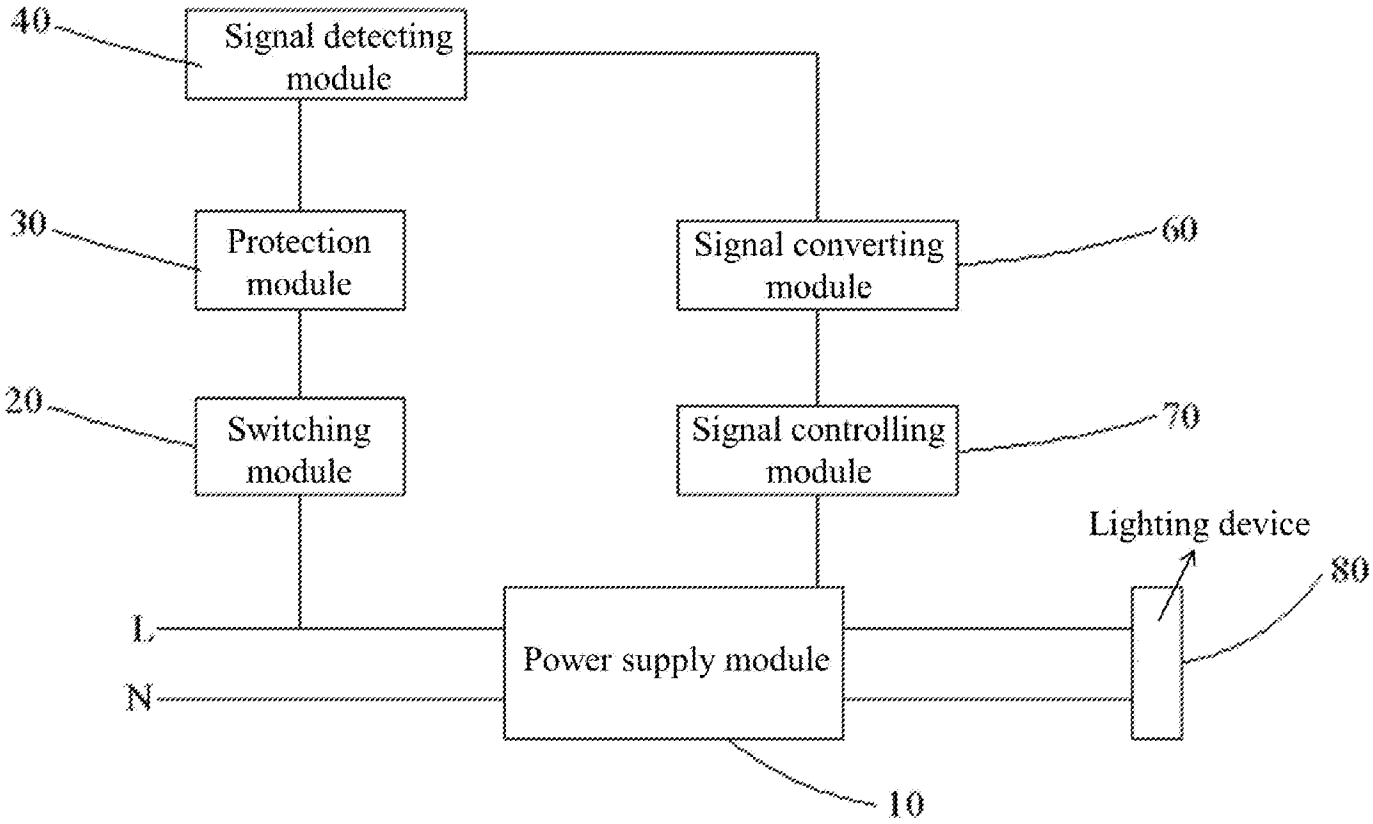
FIG. 1 is a diagram illustrating a lighting system according to an embodiment of the present invention.

The following disclosure provides many different embodiments, or examples, for implementing different features of the provided subject matter. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Embodiments of the present disclosure are discussed in detail below. It should be appreciated, however, that the present disclosure provides many applicable inventive concepts that can be embodied in a wide variety of specific contexts. The specific embodiments discussed are merely illustrative and do not limit the scope of the disclosure.

Further, spatially relative terms, such as "beneath," "below," "lower," "above," "upper", "lower", "left", "right" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly. It will be understood that when an element is referred to as being "connected to" or "coupled to" another element, it may be directly connected to or coupled to the other element, or intervening elements may be present.

Please refer to FIG. 1, which is a diagram illustrating a lighting system according to an embodiment of the present invention. The lighting system comprises a power supply control circuit (e.g. 20, 30, 40, 50, 60, 70, and/or 80) and a lighting device 80. The power supply control circuit is coupled to the lighting device 80 for controlling an operation mode of the lighting device 80. In the first embodiment of the present invention, the power supply control circuit may comprise a power supply module (or device) 10, a switching module 20, a signal detecting module 40, a signal converting module 60, and a signal controlling module 70 of FIG. 1. The power supply control circuit is arranged to control the operation mode(s), e.g. the luminance or brightness, color, or on/off, of the lighting device 80. The power supply module 10 is arranged to generate an output power to control the operation mode of the lighting device according to a control signal and a supply power. The power supply module 10 comprises a first connecting terminal (e.g. L), a second connecting terminal (e.g. N), a power output terminal, and a power input terminal. The first connecting terminal and the second connecting terminal of the power supply module 10 are coupled to the electric power system providing the supply power, and the power output terminal is arranged to provide output power to the lighting device 80. The power input terminal is arranged to receive the control signal. The electric power system may comprise a live wire (i.e. L) and a neutral wire (i.e. N), wherein the live wire may carry electric current with predetermined voltage level, and the neutral wire may couple to the ground. The first connecting terminal and the second connecting terminal of the power supply module 10 are coupled to the live wire and the neutral wire of the electric power system respectively. The switching module 20, the signal detecting module 40, the signal converting module 60, and the signal controlling module 70 are configured to modulate the output power provided to the lighting device 80 such that the luminance or brightness, color, or on/off of the lighting device 80 may be controlled.

According to the first embodiment, a terminal of the switching module 20 is coupled to the first connecting terminal of the power supply module 10, and the other terminal of the switching module 20 is coupled to a terminal of the signal detecting module 40. The switching module 20 is arranged to selectively transmit the voltage signal on the terminal of the switching module 20 to the other terminal of the switching module 20.

According to an embodiment, the switching module 20 is arranged to conduct the voltage signal to the other terminal from the terminal the switching module 20 for a first time interval to generate the control signal for controlling a first operation mode of the lighting device 80, and for conducting the voltage signal to the other terminal from the terminal of the switching module 20 for a second time interval to generate the control signal for controlling a second operation mode of the lighting device 80, wherein the first time interval is different from the second time interval. For example, when the second time interval is greater than the first time interval, the first operation mode is the switching (or on/off) mode of the lighting device 80, and the second operation mode is the luminance or color adjusting mode of the lighting device 80.

The other terminal of the signal detecting module 40 is coupled to a terminal of the signal converting module 60. The other terminal of the signal converting module 60 is coupled to a terminal of the signal controlling module 70. The other terminal of the signal controlling module 70 is coupled to the power input terminal of the power supply module 10.

According to the first embodiment, the first connecting terminal of the power supply module 10 is coupled to the first voltage signal (i.e. L) of the electric power system. The switching module 20 is arranged to control if a first current signal corresponding to the first voltage signal can be transmitted to the signal converting module 60. For example, when the switching module 20 is turned on or closed, the first voltage signal may be transmitted to the signal detecting module 40. Then, the signal detecting module 40 may detect the voltage level of the first voltage signal. Then, the first voltage signal may be transmitted to the signal converting module 60. The signal converting module 60 is arranged to convert the first voltage signal into the first current signal, and to transmit the first current signal to the signal controlling module 70. The signal controlling module 70 is arranged to convert the first current signal into a control signal, and to transmit the control signal to a connecting terminal of the power supply module 10. The control signal may adjust the output of the power supply module 10, and the luminance or brightness, color, or on/off of the lighting device 80 may be controlled accordingly.

In a second embodiment of the present invention, the power supply control circuit may comprise the power supply module 10, the switching module 20, the signal converting module 60, and the signal controlling module 70 of FIG. 1. In comparison to the first embodiment, the signal detecting module 40 is omitted in the second embodiment of the power supply control circuit.

In the second embodiment, a terminal of the switching module 20 is coupled to the first connecting terminal of the power supply module 10, and the other terminal of the switching module 20 is coupled to a terminal of the signal converting module 60. The other terminal of the signal converting module 60 is coupled to a terminal of the signal controlling module 70. The other terminal of the signal controlling module 70 is coupled to the power input terminal of the power supply module 10.

According to the second embodiment, when the switching module 20 is turned on, the first voltage signal may be transmitted to the signal converting module 60. The signal converting module 60 is arranged to convert the first voltage signal into the first current signal. The signal controlling module 70 is arranged to receive the first current signal, and to convert the first current signal into a control signal. The control signal is transmitted to the power supply module 10. The control signal is arranged to adjust the output power of the power supply module 10. Accordingly, by using the control signal to adjust the output power of the power supply module 10, the luminance, color, or on/off of the lighting device 80 may be controlled.

In comparison to the existing art, the configuration of the above mentioned embodiments of the present invention are relatively simpler and have lower cost. Therefore, the chip vendors or manufacturer may have strong market competitiveness by using the power supply control circuit of the present invention.

According to an embodiment of the present invention, the first connecting terminal and the second connecting terminal of the power supply module 10 are coupled to the live wire (L) and the neutral wire (N) of the domestic electrical connections (for example). The live wire is arranged to provide the first voltage signal to the power supply module 10 through the first connecting terminal while the switching module 20 is coupled to the first connecting terminal. Therefore, the first voltage signal is also transmitted to the switching module 20. In other words, the live wire may be the common connecting node of the first connecting terminal of the power supply module 10 and the switching module 20.

In practice, the power supply module 10 may receive power from other type of power sources. For example, the power supply module 10 may receive power from a battery. In this embodiment, the first connecting terminal of the power supply module 10 is coupled to the anode of the battery, and the second connecting terminal is coupled to the cathode of the battery. Then, the power supply module 10 may receive power from the battery. Accordingly, the embodiments of the present invention are not limited by the above mentioned power sources. As long as the power supply module 10 operates normally, the electric power system may implement with any suitable power sources.

Figure 2:
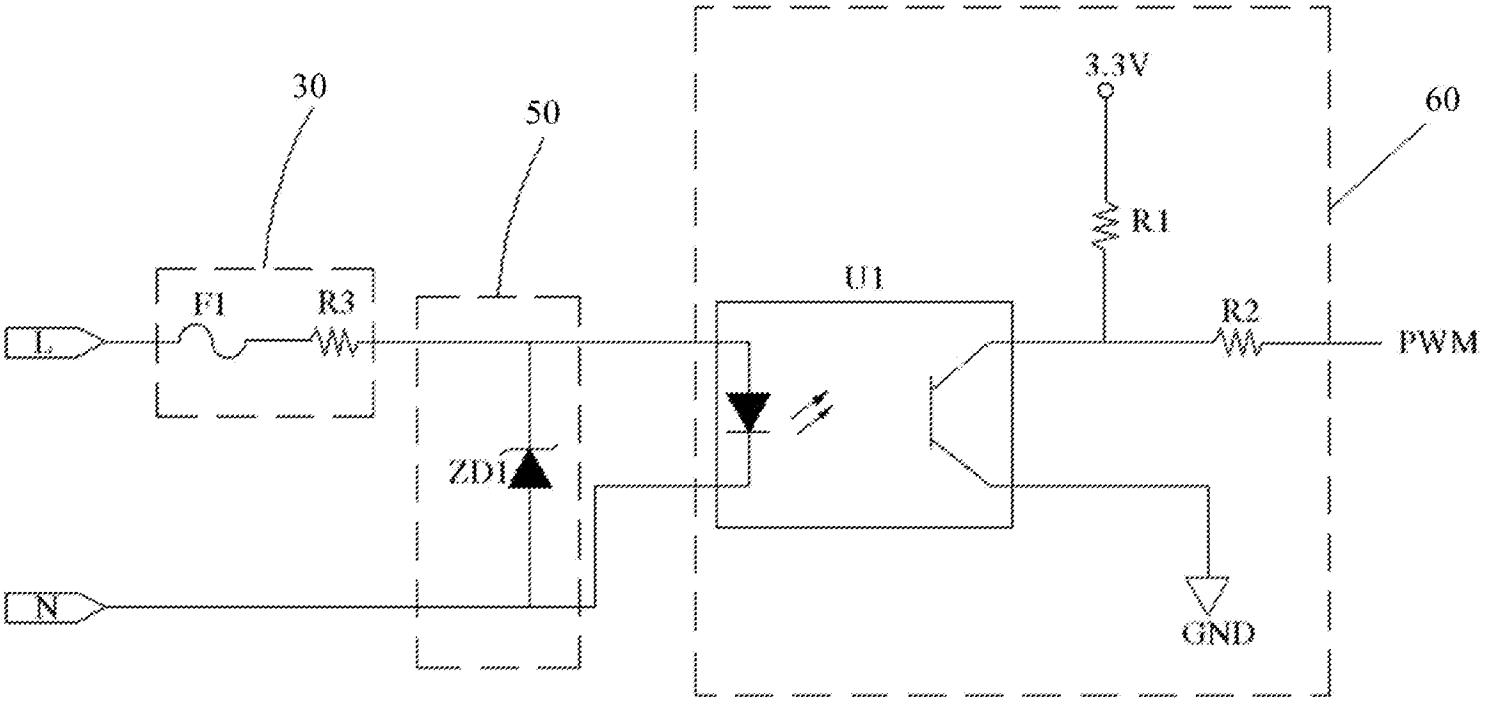
FIG. 2 is a diagram illustrating a power supply control circuit according to another embodiment of the present invention.

In an embodiment of the present invention, as shown in FIG. 2, which is a diagram illustrating a power supply control circuit according to another embodiment of the present invention. For brevity, the power supply control circuit in FIG. 2 merely shows a protection module 30, a voltage regulating module 50, and a signal converting module 60. The protection module 30 is coupled to the live wire (i.e. L) of the electric power system. The protection module 30 is arranged to protect the control circuit from the damage of the high power spike occur in the live wire. The voltage regulating module 50 is coupled between the protection module 30 and the signal converting module 60. The voltage regulating module 50 is arranged for regulating the first voltage signal to provide a relatively stable regulated signal for the signal converting module 60. The signal converting module 60 is arranged to generate a modulated signal according to the regulated signal.

Please refer to FIG. 1 and FIG. 2, in this embodiment, the signal converting module 60 comprises an optical coupler U1, a first resistor R1, and a second resistor R2. The optical coupler U1 comprises a light emitter for emitting a light signal corresponding to the first voltage signal, and a light receiver is arranged to receive or sense the emitting light signal for generating the first current signal. The light emitter comprises a first input terminal and a first output terminal. The light receiver comprises a second input terminal and a second output terminal.

According to this embodiment, the first input terminal of the light emitter is coupled to the output terminal of the voltage regulating module 50. In other words, the first input terminal of the light emitter is also coupled to the other terminal of the switching module 20 (not shown in FIG. 2) of FIG. 1. The first output terminal of the light emitter is coupled to the neutral wire (i.e. N). A terminal of the first resistor R1 is coupled to the second input terminal of the light receiver, and the other terminal of the first resistor R1 is arranged to receive a reference voltage. The reference voltage may be an external voltage. The second input terminal of the light receiver is coupled to a terminal of the second resistor R2. The second output terminal of the light receiver is coupled to the ground.

When the light receiver is turned on and the switching module 20 is closed, the first voltage signal on the live wire (i.e. L) is transmitted to the light emitter through the switching module 20. Then, the light emitter is lighted up, the light receiver is turned on or activated after being illuminated by light. Then, the connection of the path consisting the external voltage, the light receiver, and the ground is conducted. Meanwhile, the other terminal of the second resistor R2 is arranged to output the first current signal (e.g. the PWM signal), and the first current signal is transmitted to the signal controlling module 70 (not shown in FIG. 2) of FIG. 1. The signal controlling module 70 is arranged to convert the first current signal into the control signal for controlling the output voltage of the power supply module 10. For safety reasons, the external voltage may not be too large or may be limited within a predetermined range. For example, the range of the external voltage may be about 3.0V-5.0V. In one embodiment, the external voltage is 3.3V.

In practice, the light receiver may be a light sensitive transistor. A terminal of the first resistor R1 is coupled to the collector of the light sensitive transistor, a terminal of the second resistor R2 is coupled to the collector of the light sensitive transistor, and the emitter of the light sensitive transistor is coupled to the ground. According to the embodiments of the present invention as shown in FIG. 1 and FIG. 2, the protection module 30 is disposed between the switching module 20 and the signal converting module 60. The protection module 30 is arranged to protect the control circuit from high power accident. In another embodiments, the protection module 30 may be disposed between the switching module 20 and the signal detecting module 40. The protection module 30 may also be disposed in the signal detecting module 40 of FIG. 1.

In practice, the protection module 30 comprises a fuse F1 and a third resistor R3. A terminal of the fuse F1 is coupled to the switching module 20 of FIG. 1, and the other terminal of the fuse F1 is coupled to a terminal of the third resistor R3. The other terminal of the third resistor R3 is coupled to a signal converting unit (e.g. 60). In other words, the other terminal of the third resistor R3 is coupled to the first input terminal of the light emitter of the optical coupler U1. To protect the power supply control circuit, the fuse F1 may burn out or open by the high power spike occur in the live wire.

In the embodiment of the present invention as shown in FIG. 2, the voltage regulating module 50 is arranged to provide a regulated signal. A terminal of the voltage regulating module 50 is coupled to the first input terminal of the light emitter of the optical coupler U1, and the other terminal of the voltage regulating module 50 is coupled to the first output terminal of the light emitter of the optical coupler U1. When the control voltage of the light emitter is substantially stable, the light emitter may provide stable illumination.

In practice, the voltage regulating module 50 may be a Zener diode ZD1. The cathode of the Zener diode ZD1 is coupled to the first input terminal of the light emitter of the optical coupler U1, and the anode of the Zener diode ZD1 is coupled to the first output terminal of the light emitter of the optical coupler U1. In other words, the anode of the Zener diode ZD1 is coupled to the neutral wire (i.e. N).

In an embodiment of the present invention, the switching module 20 of FIG. 1 maybe a self-locking wall switch or a non-self-locking wall switch.

In one embodiment, the switching module 20 is the self-locking wall switch. When the power is on, the signal detecting module 40 may detect the voltage level (e.g. high or low) of the first voltage signal by short pressing the self-locking wall switch. The short pressing time may be the above mentioned first time interval corresponding to the first operation mode of the lighting device 80. The signal detecting module 40 may output the detected voltage level or the first voltage signal to the signal converting module 60. The signal converting module 60 is arranged to convert the detected voltage level into a pulse width modulation (PWM) signal or other signals. The PWM signal is transmitted to the signal controlling module 70. Then, the signal controlling module 70 may control the switching or on/off of the power supply module 10.

In one embodiment, the switching module 20 is the self-locking wall switch. When the power is on, the signal detecting module 40 may detect and record the voltage level of the first voltage signal for a long time by long pressing the self-locking wall switch. The long pressing time may be the above mentioned second time interval corresponding to the second operation mode of the lighting device 80. The signal converting module 60 is arranged to convert the long period of recorded signal (e.g. the detected voltage level and/or the first voltage signal) into a PWM signal or other signals. Then, the signal controlling module 70 may control the luminance or color of the lighting device 80 through the power supply module 10.

In one embodiment, the switching module 20 is the non-self-locking wall switch. When the power is on, the signal detecting module 40 may detect the voltage level (e.g. high or low) of the first voltage signal by switching (e.g. on/off) the non-self-locking wall switch. Then, the signal detecting module 40 may generate the detected voltage level to the signal converting module 60. The signal converting module 60 is arranged to convert the detected voltage level into the PWM signal or other signals. The PWM signal is transmitted to the signal controlling module 70. Then, the signal controlling module 70 may control the switching or on/off of the power supply module 10.

In practice, as shown in FIG. 1, the signal controlling module 70 may be arranged to convert the PWM signal into the PWM1 signal and the PWM2 signal. The PWM1 signal and the PWM2 signal are transmitted to the power supply module 10 for controlling the luminance and color of the lighting device 80. For example, the PWM1 signal is arranged to control the luminance of the lighting device 80, and the PWM2 signal is arranged to control the color of the lighting device 80.

Figure 3:
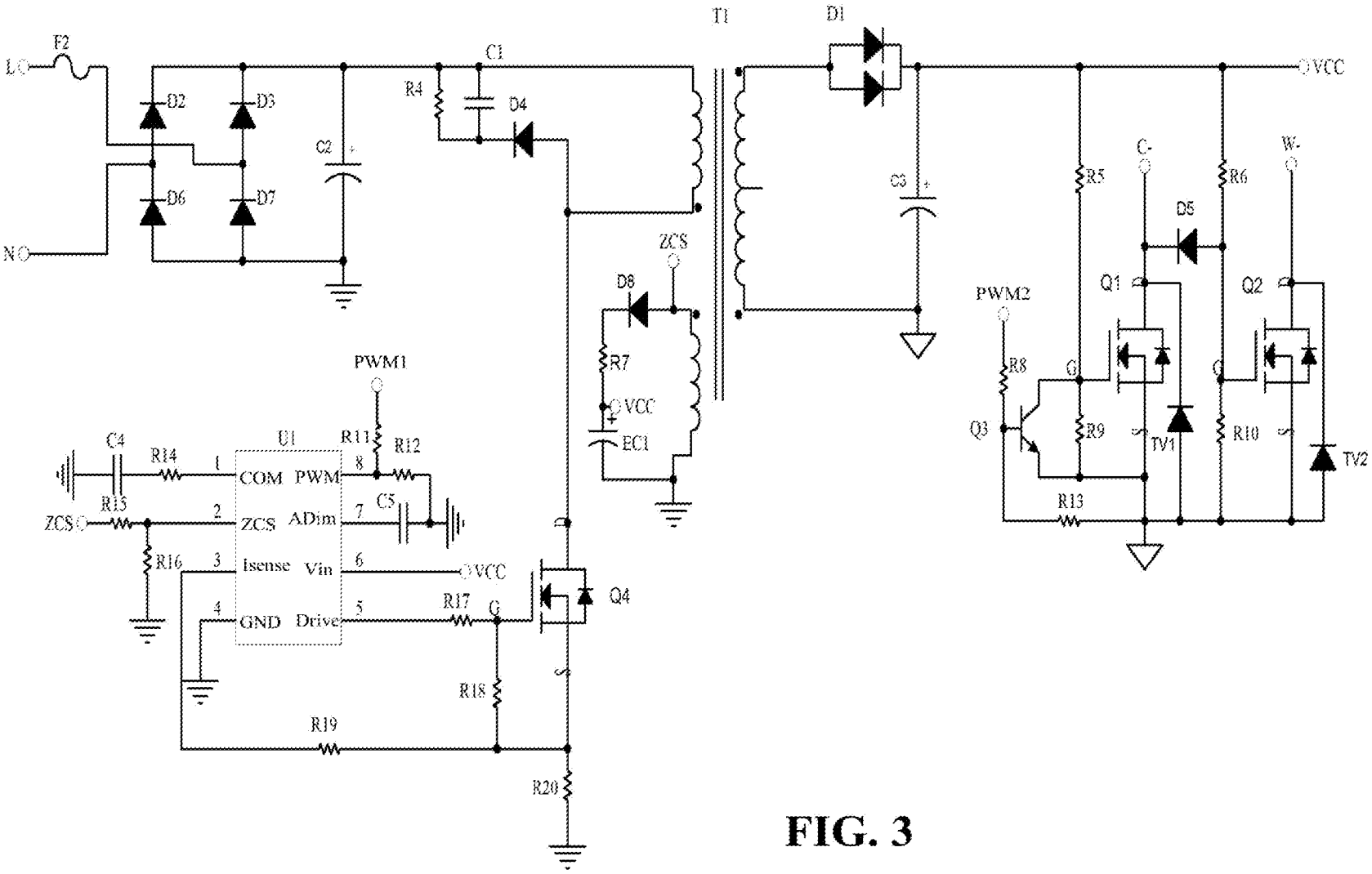
FIG. 3 is a diagram illustrating a power supply module according to an embodiment of the present invention.

In practice, as shown in FIG. 3, which is a diagram illustrating the power supply module 10 according to an embodiment of the present invention. The power supply module 10 comprises a fuse F2, diodes D1-D8, diodes TV1-TV2, resistors R3-R20, capacitors C1-C5, a transformer T1, a chip U1, a transistor Q3, and MOSFETs (Metal Oxide Semiconductor Field-Effect Transistor) Q1, Q2, and Q4.

According to the embodiment, a terminal of the fuse F2 is coupled to the live wire (L), and the other terminal of the fuse F2 is coupled to the anode of the diode D3. The cathode of the diode D3 is coupled to the positive terminal (+) of the capacitor C2, and the negative terminal of the capacitor C2 is coupled to the ground. The cathode of the diode D7 is coupled to live wire, and the anode of the diode D7 is coupled to the ground. The anode of the diode D6 is coupled to the anode of the diode D7, and the cathode of the diode D6 is coupled to the neutral wire. The anode of the diode D2 is coupled to the neutral wire (N), and the cathode of the diode D2 is coupled to the positive terminal of the electrolytic capacitor C2. A terminal of the resistor R4 is coupled to the positive terminal of the electrolytic capacitor C2, and the other terminal of the resistor R4 is coupled to the cathode of the diode D4. The anode the diode D4 is coupled to the drain of the MOSFET Q4.

The source of the MOSFET Q4 is coupled to a terminal of the resistor R20. The other terminal of the resistor R20 is coupled to the ground. A terminal of the resistor R18 is coupled to a terminal of the resistor R20, and the other terminal of the resistor R18 is coupled to the gate of the MOSFET Q4. A terminal of the resistor R19 is coupled to a terminal of the resistor R20, and the other terminal of the resistor R19 is coupled to the Isense terminal (i.e. terminal 3) of the chip U1. The chip U1 may be a controlling IC (Integrated Circuit) of the power supply module 10. A terminal of the resistor R17 is coupled to the gate of the MOSFET Q4, and the other terminal of the resistor R17 is coupled to the Drive terminal (i.e. terminal 5) of the chip U1. A terminal of the capacitor C5 is coupled to the ground, and the other terminal of the capacitor C5 is coupled to ADim terminal (i.e. terminal 7) of the chip U1. A terminal of the resistor R12 is coupled to the ground, and the other terminal of the resistor R12 is coupled to the PWM terminal (i.e. terminal 8) of the chip U1. A terminal of the resistor R11 is coupled to the PWM terminal of the chip U1, and the other terminal of the resistor R11 is arranged to receive the PWM1 SIGNAL. A terminal of the resistor R14 is coupled to the COM terminal (i.e. terminal 1) of the chip U1, and the other terminal of the resistor R14 is coupled to a terminal of the capacitor C4. The other terminal of the capacitor C4 is coupled to the ground. A terminal of the resistor R15 is coupled to the ZCS terminal (i.e. terminal 2) of the chip U1, and the other terminal of the resistor R15 is arranged to output a ZCS signal. A terminal of the resistor R16 is coupled to a terminal of the resistor R15, and the other terminal of the resistor R16 is coupled to the ground. The GND terminal (i.e. terminal 4) of the chip U1 is coupled to the ground.

A terminal of the capacitor C1 is coupled to a terminal of the resistor R4, and the other terminal of the capacitor C1 is coupled to the other terminal of the resistor R4. A terminal of the resistor R4 is coupled to a terminal of the first primary winding of the transformer T1, the other terminal of the first primary winding of the transformer T1 is coupled to the anode of the diode D4. A terminal of the second primary winding of the transformer T1 is arranged to receive the ZCS signal, and the other terminal of the second primary winding of the transformer T1 is coupled to the ground. The other terminal of the second primary winding of the transformer T1 is coupled to the negative terminal of the electrolytic capacitor EC1. A terminal of the resistor R7 is coupled to the positive terminal of the electrolytic capacitor EC1, and the other terminal of the resistor R7 is coupled to the cathode of the diode D8. The anode of the diode D8 is coupled to a terminal of the second primary winding of the transformer T1. A terminal of the secondary winding of the transformer T1 is coupled to a terminal of the diode D1, and the other terminal of the secondary winding of the transformer T1 is coupled to the ground. The positive terminal of the electrolytic capacitor C3 is coupled to the cathode of the diode D1, and the negative terminal of the electrolytic capacitor C3 is coupled to the ground. The cathode of the diode D1 is arranged to output the VCC signal.

A terminal of the resistor R5 is coupled to the cathode of the diode D1. The other terminal of the resistor R5 is coupled to a terminal of the resistor R9, and the other terminal of the resistor R9 is coupled to the ground. The collector of the transistor Q3 is coupled to a terminal of the resistor R9, the emitter of the transistor Q3 is coupled to the other transistor of the resistor R9. The base of the transistor Q3 is coupled to a terminal of the resistor R8, and the other terminal of the resistor R8 is arranged to receive the PWM2 SIGNAL. The terminal of the resistor R8 is coupled to a terminal of the resistor R13, and the other terminal of the resistor R13 is coupled to the ground. The source of the MOSFET Q1 is coupled to the ground, the gate of the MOSFET Q1 is coupled to a terminal of the resistor R9, and the drain of the MOSFET Q1 is arranged to output the signal C−. The cathode of the diode TV1 is arranged to couple to the drain of the MOSFET Q1, and the anode of the diode TV1 is coupled to the ground. The cathode of the diode D5 is coupled to the drain of the MOSFET Q1, and the anode of the diode D5 is coupled to a terminal of the resistor R6. The other terminal of the resistor R6 is coupled to the cathode of the diode D1. A terminal of the resistor R10 is coupled to the anode of the diode D5, and the other terminal of the resistor R10 is coupled to the ground. The gate of the MOSFET Q2 is coupled to the anode of the diode D5, the drain of the MOSFET Q2 is arranged to output the signal W−, and the source of the MOSFET Q2 is coupled to the ground. The cathode of the diode TV2 is coupled to the drain of the MOSFET Q2, and the anode of the diode TV2 is coupled to the ground. By using the chip U1 to control the duty cycle of the signal outputting to the MOSFET Q4, the magnitude of the VCC signal outputted by the transformer T1 may be controlled. Accordingly, the luminance of the lighting device 80 may be controlled. Moreover, the color of the lighting device 80 may also be controlled by the signal W− and the signal C−.

In practice, the signal controlling module 70 may be a Zigbee module or BLE (Bluetooth Low Energy) module, or any other microcontroller units (MCU).

Briefly, the configuration of the above mentioned power supply control circuit are relatively simpler and have lower cost. Therefore, the chip vendors or lighting system manufacturer may have strong market competitiveness by using the power supply control circuit of the present invention.

In addition, terms such as "first" and "second" are used herein for purposes of description and are not intended to indicate or imply relative importance or significance or to imply the number of indicated technical features. Thus, the feature defined with "first" and "second" may include one or more of this feature. In the description of the present disclosure, "a plurality of" means two or more than two, unless specified otherwise.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed, that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A control circuit, comprising:

a power supply module, arranged to generate an output power to control an operation mode of a lighting device according to a control signal and a supply power;

a switching module, coupled to the supply power, for selectively generating a first voltage signal of the supply power;

a signal controlling module coupled between the switching module and the power supply module, for generating the control signal according to the first voltage signal, wherein the switching module comprises a self-locking wall switch; and a signal detecting module coupled between the switching module and the signal controlling module, for detecting a voltage level of the first voltage signal received from the switching module;

a signal converting module, coupled between the switching module and the signal controlling module, for converting the first voltage signal into a first current signal; and wherein the signal controlling module is arranged to generate the control signal according to the first current signal.

2. The control circuit of claim 1, wherein the power supply module comprises a first connecting terminal and a second connecting terminal, the first connecting terminal is coupled to the first voltage signal of the supply power and the second connecting terminal is coupled to a reference voltage of the supply power, and the switching module is coupled to the first connecting terminal.

3. The control circuit of claim 1, wherein the first current signal is a pulse width modulation (PWM) signal.

4. The control circuit of claim 1, further comprising:

a signal detecting module coupled between the switching module and the signal converting module, for detecting a voltage level of the first voltage signal received from the switching module.

5. The control circuit of claim 4, further comprising:

a protection module coupled between the switching module and the signal detecting module, for protecting the control circuit from a power spike occur in the supply power.

6. The control circuit of claim 5, wherein the protection module comprises:

a fuse, having a first terminal coupled to the switching module; and a resistor, having a first terminal coupled to a second terminal of the fuse, and a second terminal coupled to the signal detecting module.

7. The control circuit of claim 1, wherein the signal converting module comprises:

an optical coupler, having a light emitter and a light receiver;

wherein the light emitter is coupled to the switching module for generating a light signal according to the first voltage signal, and the light receiver is arranged to generate the first current signal by sensing the light signal.

8. The control circuit of claim 7, wherein the signal converting module further comprises:

a first resistor, having a first terminal coupled to an input terminal of the light receiver, and a second terminal for receiving an external voltage; and a second resistor, having a first terminal coupled to the input terminal of the light receiver, and a second terminal for outputting the first current signal;

wherein an output terminal of the light receiver is coupled to a reference voltage.

9. The control circuit of claim 8, wherein the external voltage falls within a range of 3.0V-5.0V.

10. The control circuit of claim 1, further comprising:

a voltage regulating module, coupled between the switching module and the signal controlling module, for regulating the first voltage signal.

11. The control circuit of claim 10, wherein the voltage regulating module comprises:

a Zener diode, having an anode coupled to the switching module and the signal controlling module, and a cathode coupled to a reference voltage.

12. A control circuit, comprising:

a power supply module, having a first connecting terminal coupled to a first voltage signal of a supply power, a second connecting terminal receiving a control signal, and an output terminal generating an output power to a lighting device according to the control signal and the supply power; and a switching module, having a first terminal coupled to the first connecting terminal, and a second terminal coupled to the second connecting terminal, for conducting the first voltage signal to the second terminal from the first terminal for a first time interval to generate the control signal for controlling a first operation mode of the lighting device, and for conducting the first voltage signal to the second terminal from the first terminal for a second time interval to generate the control signal for controlling a second operation mode of the lighting device;

wherein the first time interval is different from the second time interval.

13. The control circuit of claim 12, wherein the second time interval is greater than the first time interval, the first operation mode is a switching mode of the lighting device, and the second operation mode is a luminance or color adjusting mode of the lighting device.

14. The control circuit of claim 12, wherein the switching module comprises a self-locking wall switch or a non-self-locking wall switch.

15. A lighting system, comprising:

a lighting device; and a control circuit, coupled to the lighting device, for controlling an operation mode of the lighting device, and the control circuit comprising:

a power supply module, arranged to generate an output power to control the operation mode of the lighting device according to a control signal and a supply power;

a switching module, coupled to the supply power, for selectively generating a first voltage signal of the supply power;

a signal controlling module coupled between the switching module and the power supply module, for generating the control signal according to the first voltage signal;

a signal detecting module coupled between the switching module and the signal controlling module, for detecting a voltage level of the first voltage signal received from the switching module; and a signal converting module, coupled between the switching module and the signal controlling module, for converting the first voltage signal into a first current signal;

wherein the signal controlling module is arranged to generate the control signal according to the first current signal, wherein the switching module comprises a self-locking wall switch.

* * * * *